US007429093B2

(12) United States Patent
Shinkawa

(10) Patent No.: US 7,429,093 B2
(45) Date of Patent: Sep. 30, 2008

(54) DROPLET DISCHARGING DEVICE AND METHOD OF DETECTING DISCHARGE ABNORMALITY THEREOF

(75) Inventor: Osamu Shinkawa, Chino (JP)

(73) Assignee: Seiko Epson Corporation (JP)

( * ) Notice: Subject to any disclaimer, the term of this patent is extended or adjusted under 35 U.S.C. 154(b) by 304 days.

(21) Appl. No.: 11/089,249

(22) Filed: Mar. 24, 2005

(65) Prior Publication Data

US 2005/0212845 A1 Sep. 29, 2005

(30) Foreign Application Priority Data

Mar. 26, 2004 (JP) ..... 2004-092356
May 28, 2004 (JP) ..... 2004-159366

(51) Int. Cl.
*B41J 29/393* (2006.01)
*B41J 2/15* (2006.01)

(52) U.S. Cl. ..... 347/19; 347/20

(58) Field of Classification Search ..... 347/19, 347/20; 702/179, 181, 182, 183; 705/1, 705/7, 8, 9, 50; 706/16, 21, 25, 46, 47, 50, 706/54, 55, 61; 703/2
See application file for complete search history.

(56) References Cited

U.S. PATENT DOCUMENTS 5,673,071 A * 9/1997 Fuse ..... 347/35
6,193,342 B1 * 2/2001 Suzuki ..... 347/9
6,364,444 B1 * 4/2002 Ota ..... 347/10
6,454,377 B1 * 9/2002 Ishizaki ..... 347/15
2002/0181963 A1 * 12/2002 Takeda ..... 399/45
2004/0113965 A1 * 6/2004 Kosugi et al. ..... 347/19
2004/0227780 A1 * 11/2004 Beck et al. ..... 347/12
2005/0116977 A1 * 6/2005 Shinkawa et al. ..... 347/14
2005/0166392 A1 * 8/2005 Kurata et al. ..... 29/720

FOREIGN PATENT DOCUMENTS

JP 63-141750 6/1988
JP 2000-355100 12/2000
JP 2002-192740 7/2002

* cited by examiner

*Primary Examiner*—An H. Do
*Assistant Examiner*—Sarah Al Hashimi
(74) *Attorney, Agent, or Firm*—Harness, Dickey & Pierce, P.L.C.

(57) ABSTRACT

A droplet discharging device is provided which does not require a special sensor (an optical sensor) and can enhance the precision of detecting a discharge abnormality of ink droplets. When printing is to be carried out, a transistor having a large current capacitance is turned on, a driving signal is applied from a driving circuit to piezoelectric actuators, and ink droplets are discharged by corresponding nozzles. Upon detecting a discharge abnormality of the nozzles, one of the piezoelectric actuators corresponding to the nozzles is selected, the transistor is turned off and a switch is turned on. A driving voltage is then applied from the driving circuit to the piezoelectric actuator thus selected in this state. When the application of the driving voltage ends, the switch is turned off. Consequently, a residual vibration detecting circuit detects the electromotive voltage of the piezoelectric actuator by the residual vibration of a vibrating plate.

7 Claims, 12 Drawing Sheets

DROPLET DISCHARGING DEVICE AND METHOD OF DETECTING DISCHARGE ABNORMALITY THEREOF

RELATED APPLICATIONS

This application claims priority to Japanese Patent Application Nos. 2004-092356 filed Mar. 26, 2004 and 2004-159366 filed May 28, 2004 which are hereby expressly incorporated by reference herein in their entirety.

BACKGROUND

1. Technical Field

The present invention relates to a droplet discharging device such as an inkjet printer and a method of detecting a discharge abnormality thereof.

2. Related Art

An inkjet printer to be one of droplet discharging devices discharges ink drops (droplets) from a plurality of nozzles, thereby forming an image on a predetermined paper. An inkjet head (a printing head) of the inkjet printer is provided with a large number of nozzles, and there are some cases in which the ink drops cannot be discharged because some of the nozzles are clogged due to an increase in the viscosity of an ink, the entrainment of bubbles or the adherence of dust or paper dust. If the nozzles are clogged, dot dropouts are produced within an image so that image quality is deteriorated.

In order to eliminate such a drawback, as a device for checking whether ink droplets are discharged or not, there has conventionally been known a device for detecting a change in the intensity of a light which is caused by the passage of the ink droplets through a light emitting unit and a light receiving unit provided with nozzles for discharging an ink interposed therebetween, thereby confirming the operation of each of the nozzles by the light emitting unit and the light receiving unit (for example, see JP-A-2002-192740 Publication).

In a conventional device for optically detecting whether or not ink droplets are discharged from each of the nozzles, however, there are the following drawbacks.

More specifically, a space for installing an optical sensor is required, and furthermore, a detecting position in which the ink droplets pass through a light receiving region is set to be high or precision in a detection timing is to be enhanced in order to detect very small ink droplets with a high sensitivity.

In consideration of the respects described above, it is an object of the invention to provide a droplet discharging device which does not require a special sensor such as an optical sensor and can enhance the reliability of precision in the detection of the discharge abnormality of ink droplets by a comparatively simple structure, and a method of detecting a discharge abnormality thereof.

SUMMARY

In order to solve the problems and to attain the object of the invention, each invention has the following structure.

More specifically, a first invention is directed to a droplet discharging device comprising a head unit including a plurality of droplet discharging heads having a vibrating plate, a piezoelectric actuator for displacing the vibrating plate, a cavity filled with a liquid and having a pressure in an inner part which is increased and decreased by the displacement of the vibrating plate, and a nozzle communicating with the cavity and serving to discharge the liquid as droplets by the increase and decrease in the pressure in the inner part, a driving unit for outputting a driving signal to drive each of the piezoelectric actuators of the droplet discharging heads, a nozzle selecting unit for selecting each of the nozzles of the droplet discharging heads and supplying the driving signal from the driving unit to the piezoelectric actuator corresponding to the nozzle thus selected, a residual vibration detecting unit for detecting a residual vibration of the vibrating plate connected to each of the piezoelectric actuators, a first switch unit having a large current capacitance which can connect an electrode on a ground side of the piezoelectric actuator and the ground, and a second switch unit having a small current capacitance which can connect the electrode on the ground side of the piezoelectric actuator and the ground.

In a second invention according to the first invention, there is further provided a switch control unit for carrying out a predetermined opening and closing control of each of the first switch unit and the second switch unit when detecting a discharge abnormality of the nozzle.

In a third invention according to the second invention, the switch control unit serves to carry out a control to close the second switch unit in a state in which the first switch unit is maintained to be opened and to open the second switch unit after the driving signal is applied from the driving unit to the piezoelectric actuator corresponding to the nozzle selected by the nozzle selecting unit when detecting the discharge abnormality of the nozzle.

In a fourth invention according to any of the first to third inventions, the residual vibration detecting unit serves to detect an AC voltage generated between the ground and the electrode on the ground side of the piezoelectric actuator when the second switch unit is brought into an opening state and the electrode on the ground side of the piezoelectric actuator related to the nozzle to be a detection object is separated from the ground side in the detection of the discharge abnormality of the nozzle.

In a fifth invention according to any of the first to fourth inventions, the nozzle selecting unit serves to select the nozzles of the droplet discharging heads one by one based on data for nozzle selection and to supply the driving signal from the driving unit to the piezoelectric actuator corresponding to the nozzle thus selected when detecting the discharge abnormality of the nozzle.

In a sixth invention according to any of the first to fifth inventions, a switching speed of the second switch unit is set to be higher than that of the first switch unit.

A seventh invention is directed to a droplet discharging device comprising a head unit including a plurality of droplet discharging heads having a vibrating plate, a piezoelectric actuator for displacing the vibrating plate, a cavity filled with a liquid and having a pressure in an inner part which is increased and decreased by the displacement of the vibrating plate, and a nozzle communicating with the cavity and serving to discharge the liquid as droplets by the increase and decrease in the pressure in the inner part, a driving unit for outputting a driving signal to drive each of the piezoelectric actuators of the droplet discharging heads, a nozzle selecting unit for selecting each of the nozzles of the droplet discharging heads and supplying the driving signal from the driving unit to the piezoelectric actuator corresponding to the nozzle thus selected, a residual vibration detecting unit for detecting a residual vibration of the vibrating plate connected to the piezoelectric actuator, and a switch unit capable of connecting an electrode on a ground side of the piezoelectric actuator and the ground.

In an eighth invention according to the seventh invention, there is further provided a switch control unit for carrying out a predetermined opening and closing control of the switch unit.

In a ninth invention according to the eighth invention, the switch control unit serves to carry out a control to close the switch unit and to open the switch unit after the driving signal is applied from the driving unit to the piezoelectric actuator corresponding to the nozzle selected by the nozzle selecting unit when detecting a discharge abnormality of the nozzle.

In a tenth invention according to any of the seventh to ninth inventions, the residual vibration detecting unit serves to detect an AC voltage generated between the ground and the electrode on the ground side of the piezoelectric actuator when the switch unit is brought into an opening state and the electrode on the ground side of the piezoelectric actuator related to the nozzle to be a detection object is separated from the ground side in the detection of the discharge abnormality of the nozzle.

In an eleventh invention according to any of the seventh to tenth inventions, the nozzle selecting unit serves to select the nozzles of the droplet discharging heads one by one based on data for nozzle selection and to supply the driving signal from the driving unit to the piezoelectric actuator corresponding to the nozzle thus selected when detecting the discharge abnormality of the nozzle.

In a twelfth invention according to any of the seventh to eleventh inventions, the switch unit is constituted by a switching unit having a current capacitance which can be driven when the piezoelectric actuators are driven at the same time.

A thirteenth invention is directed to a method of detecting a discharge abnormality of a droplet discharging device comprising a head unit including a plurality of droplet discharging heads having a vibrating plate, a piezoelectric actuator for displacing the vibrating plate, a cavity filled with a liquid and having a pressure in an inner part which is increased and decreased by the displacement of the vibrating plate, and a nozzle communicating with the cavity and serving to discharge the liquid as droplets by the increase and decrease in the pressure within the cavity, comprising the steps of selecting any of the piezoelectric actuators which is related to the nozzle to be a check object, connecting one end of the piezoelectric actuator thus selected to a driving signal source and connecting the other end to a ground, thereby applying a driving signal to the piezoelectric actuator and driving the piezoelectric actuator, and discharging droplets from the nozzle, and separating an electrode on the ground side of the piezoelectric actuator from the ground side and detecting, as a residual vibration of the vibrating plate, an AC voltage generated between the ground and the electrode on the ground side of the piezoelectric actuator after discharging the droplets.

In a fourteenth invention according to the thirteenth invention, there is further provided the step of deciding presence of a discharge abnormality of the nozzle to be a detection object based on the residual vibration detected at the detecting step.

In a fifteenth invention according to the thirteenth or fourteenth invention, each of the selecting, discharging and detecting steps or each of the selecting, discharging, detecting and deciding steps is carried out for each of the piezoelectric actuators corresponding to each of the nozzles provided in each of the droplet discharging heads.

According to the invention having such structures, a special sensor such as an optical sensor is not required, and furthermore, the reliability of precision in the detection of the discharge abnormality of ink droplets can be enhanced by a comparatively simple structure.

According to the invention, moreover, a power transistor can be used as the first switch unit in printing and an analog switch capable of being turned ON/OFF at a high speed can be used as the second switch unit in the detection of the discharge abnormality of the nozzles. Therefore, it is possible to accurately detect the residual vibration of the vibrating plate which is generated after supplying the driving signal to the piezoelectric actuator.

DETAILED DESCRIPTION

Embodiments of a droplet discharging device and a method of detecting a discharge abnormality thereof according to the invention will be described below with reference to the drawings.

First Embodiment

Figure 1:
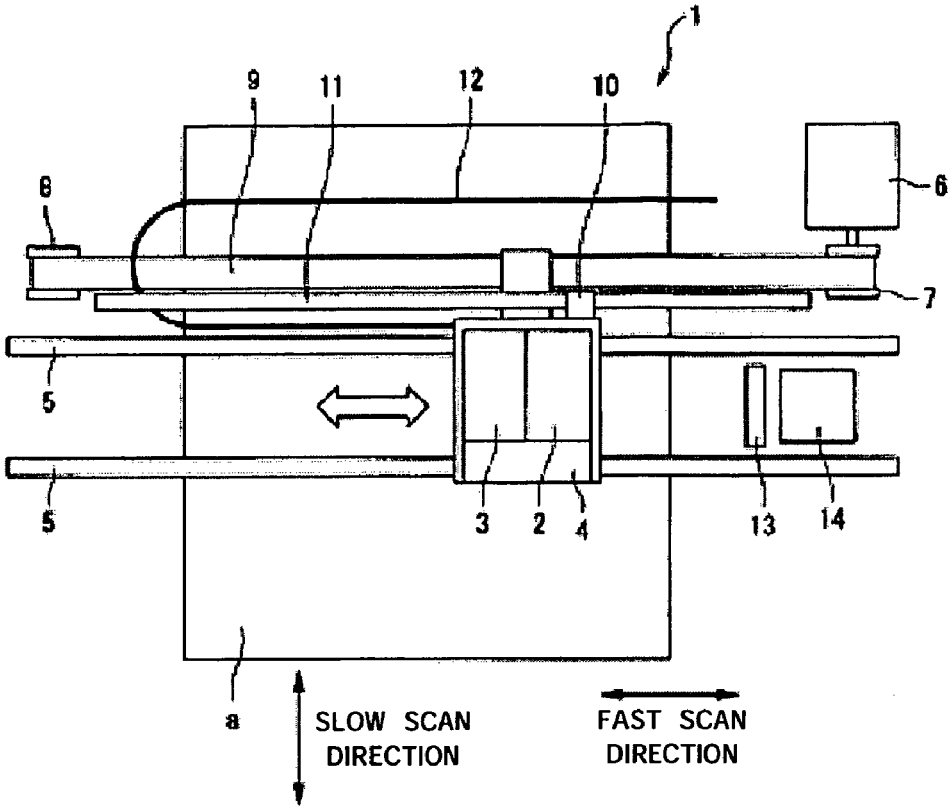
FIG. 1 is a plan view showing the schematic structure of an inkjet printer to be one of droplet discharging devices according to a first embodiment of the invention.

FIG. 1 is a plan view showing the schematic structure of an inkjet printer 1 to be one of droplet discharging devices according to a first embodiment of the invention.

The inkjet printer 1 comprises a carriage 4 mounting a head unit 2 and an ink cartridge 3 thereon as shown in FIG. 1, and the carriage 4 can be guided by a pair of carriage shafts 5 and can be thus moved in a fast scan direction. Moreover, a part of the carriage 4 is fixed to a toothed belt 9, and the toothed belt 9 is laid between a driving pulley 7 and a driven pulley 8 which are fixed to the rotating shaft of a motor 6.

Furthermore, an encoder 10 is attached to the carriage 4 and a linear scale 11 is provided in the direction of movement of the carriage 4. Consequently, the position of the head unit 2 on the carriage 4 is detected by the encoder 10.

In FIG. 1, 12 denotes a cable for electrically connecting the head unit 2 and a system controller. 13 denotes a wiper for cleaning the surface of an inkjet head which will be described below. 14 denotes a cap for capping a nozzle base plate (see FIG. 3) of the inkjet head.

In the inkjet printer 1 having such a structure, when a detection signal of the encoder 10 is input to a motor control circuit (not shown), the rotating operation of the motor 6 is controlled by the motor control circuit in the following manner. More specifically, the control is carried out in acceleration, a constant speed, deceleration, reverse, acceleration, a constant speed, deceleration, reverse and the like.

With the operation of the motor 6, the carriage 4 repeats a reciprocation in a fast scan direction and a section at the constant speed corresponds to a printing region. Therefore, ink droplets are discharged, onto a recording paper a, from the nozzle of the head unit 2 mounted on the carriage 4 in the control to be performed at the constant speed. As a result, predetermined characters and images are recorded on the recording paper a by the ink droplets.

Next, the specific structure of the head unit 2 shown in FIG. 1 will be described with reference to FIGS. 2 and 3.

Figure 2:
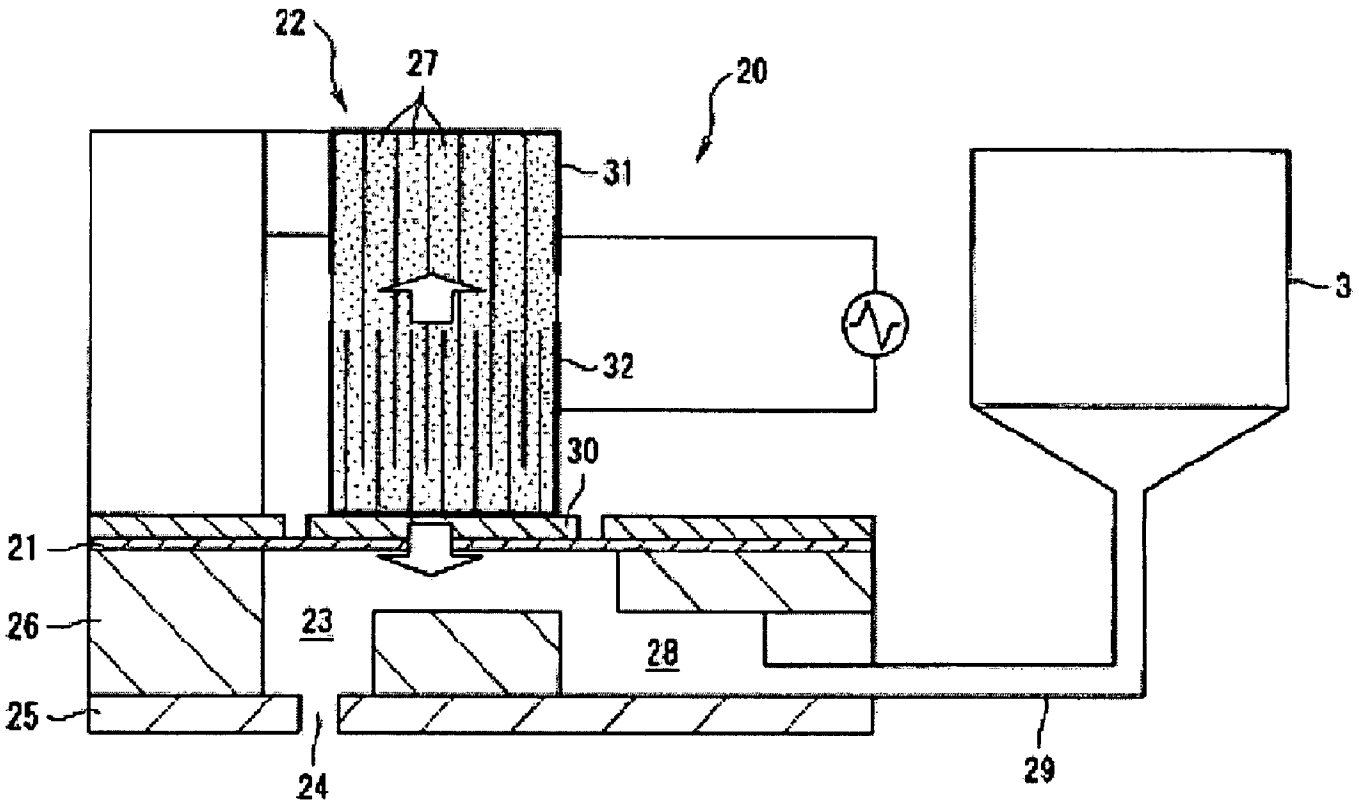
FIG. 2 is a sectional view showing the structure of the inkjet head of the inkjet printer illustrated in FIG. 1.

The head unit 2 includes a plurality of inkjet heads (droplet discharging heads) 20 shown in FIG. 2, and a piezoelectric actuator is used for each of the inkjet heads 20.

As shown in FIG. 2, the inkjet head 20 includes at least a vibrating plate 21, a piezoelectric actuator 22 for displacing the vibrating plate 21, a cavity (a pressure chamber) 23 filled with an ink to be a liquid and having a pressure in an inner part which is increased and decreased by the displacement of the vibrating plate 21, and a nozzle 24 communicating with the cavity 23 and discharging the ink as droplets by the increase and decrease in the pressure within the cavity 23.

In more detail, the inkjet head 20 includes a nozzle base plate 25 having the nozzle 24 formed thereon, a cavity base plate 26, the vibrating plate 21, and the piezoelectric actuator 22 of a lamination type in which a plurality of piezoelectric units 27 is provided.

The cavity base plate 26 is formed to take a predetermined shape as shown. Consequently, the cavity 23 and a reservoir 28 communicating therewith are formed. Moreover, the reservoir 28 is connected to the ink cartridge 3 through an ink supply tube 29.

The piezoelectric actuator 22 is constituted by comb-toothed electrodes 31 and 32 provided opposite to each other and the piezoelectric units 27 provided alternately with each of the comb teeth of the electrodes 31 and 32. Moreover, the piezoelectric actuator 22 has one end side bonded to the vibrating plate 21 through an intermediate layer 30 as shown in FIG. 2.

The piezoelectric actuator 22 having such a structure utilizes a mode for expansion and contraction in a vertical direction as shown in FIG. 2 by a driving signal sent from a driving signal source which is applied between the first electrode 31 and the second electrode 32. The piezoelectric actuator 22 features that a great driving force is obtained because the piezoelectric unit 27 is provided.

In the piezoelectric actuator 22, accordingly, when the driving signal shown in FIG. 2 is applied, a displacement is generated on the vibrating plate 21 so that a pressure in the cavity 23 is changed and ink droplets are discharged from the nozzle 24.

Figure 3:
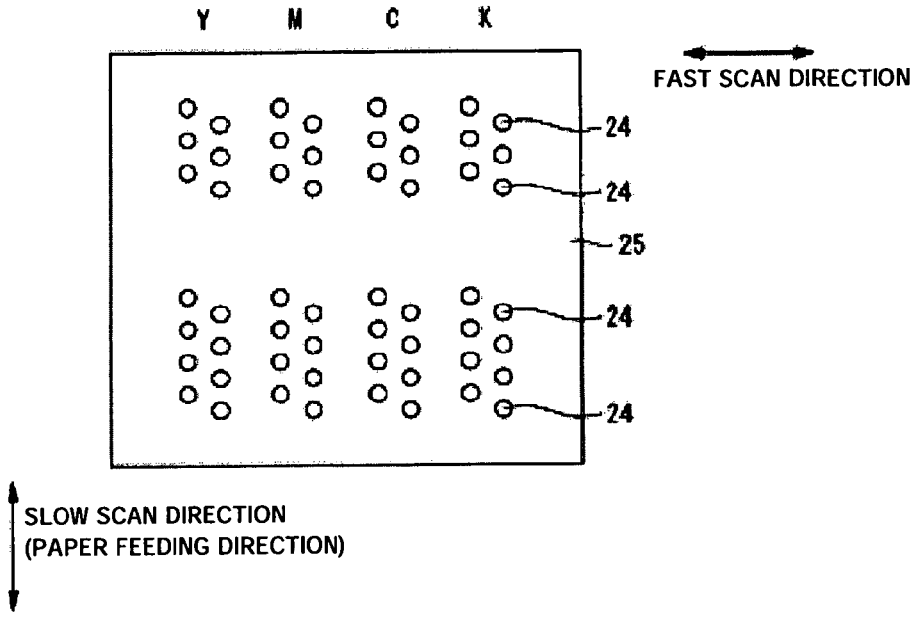
FIG. 3 is a plan view showing the structure of the nozzle base plate of the head illustrated in FIG. 2.

The nozzle 24 for each inkjet head 20 formed on the nozzle base plate 26 shown in FIG. 2 is arranged as shown in FIG. 3, for example. In the example of FIG. 3, there is shown an array pattern of the nozzle 24 which is applied to inks having four colors (Y, M, C and K).

In the inkjet printer 1 comprising the inkjet head 20, the discharge abnormality (non-discharge) of ink droplets, that is, a so-called dot dropout phenomenon presents itself, for example, the ink droplets cannot be discharged from the nozzle 24 due to the runout of the ink, the generation of bubbles, clogging (drying) and the adherence of paper dust when they are to be discharged.

The paper dust implies a fiber or an aggregation thereof which is easily generated when a recording paper formed by wood pulp to be a raw material frictionally comes in contact with a paper feed roller and is formed by a part of the recording paper.

Next, the detection principle of the discharge abnormality of ink droplets according to the invention will be described with reference to FIGS. 2, 4 and 5.

When a driving signal is supplied from a driving circuit which will be described below to the piezoelectric actuator 22 shown in FIG. 2, the vibrating plate 21 is flexed so that a volume in the cavity 23 is increased and then decreased. At this time, a part of the ink filing in the cavity 23 is discharged as ink droplets from the nozzle 24 communicating with the cavity 23 by a pressure generated in the cavity 23.

By the serial operation of the vibrating plate 21, the vibrating plate 21 carries out a free vibration at a natural vibration frequency determined by an acoustic resistance r obtained by the nozzle 24, an ink supply port or the viscosity of the ink, an inertance m based on the weight of the ink in an ink passage and a compliance c of the vibrating plate 21. The free vibration carried out by the vibrating plate 21 will be hereinafter referred to as a residual vibration.

Figure 4:
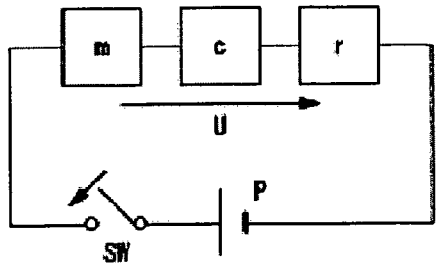
FIG. 4 is a circuit diagram showing the calculation model of a simple vibration assuming the residual vibration of a vibrating plate illustrated in FIG. 2.
Figure 5:
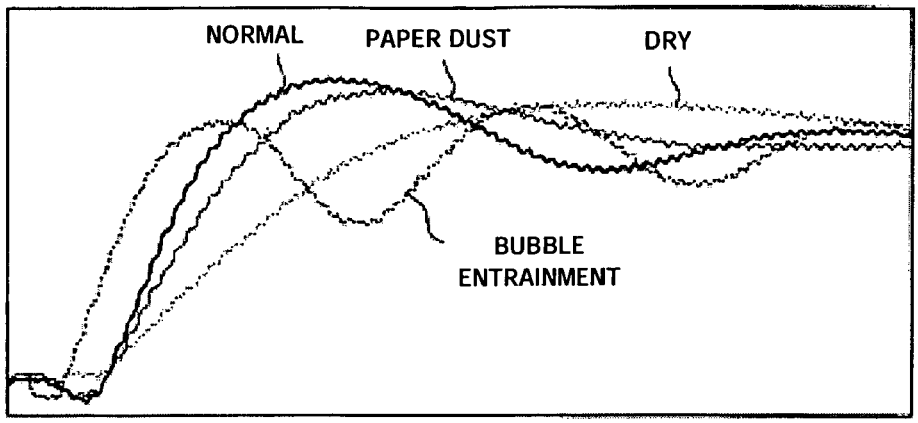
FIG. 5 is a chart showing an example of the experimental result of the detected waveform of the residual vibration in the vibrating plate illustrated in FIG. 2 in normal and abnormal cases.

FIG. 4 shows the calculation model of a simple vibration assuming the residual vibration of the vibrating plate 21. By calculating a step response in the application of a sound pressure P to the calculation model with respect to a volume velocity u, it is possible to obtain the following equation.

Equation 1

$$u = \frac{P}{\omega \cdot m} e^{-\omega t} \cdot \sin\omega t (\mathrm{m}^3/\mathrm{s}) \tag{1}$$

$$\omega = \sqrt{\frac{1}{m \cdot C} - \alpha^2} \tag{2}$$

$$\alpha = \frac{r}{2m} \tag{3}$$

When the inkjet head 20 shown in FIG. 2 normally discharges an ink and there is no change in the acoustic resistance r, the inertance m and the compliance c, the residual vibration of the vibrating plate 21 always gives a constant waveform.

When the discharge of the ink is defective and dot dropouts occur, however, the waveform of the residual vibration of the vibrating plate 21 becomes different from that in a normal condition. FIG. 5 shows an example of the experimental result of the detected waveform of the residual vibration. The following has been found from the experimental result and the calculation model of the simple vibration.

In the case in which the ink passage or the tip of the nozzle is clogged with bubbles, the weight of the ink is decreased corresponding to the entrainment of the bubbles and the inertance m is reduced, and the acoustic resistance r is decreased and a frequency is raised equivalently to the case in which the diameter of the nozzle is increased by the bubbles. Thus, it is possible to detect a characteristic residual vibration waveform (see "bubble entrainment" in FIG. 5).

In the case in which the ink in the nozzle portion is dried and is not discharged, the viscosity of the ink in the vicinity of the nozzle is increased due to the dryness so that the acoustic resistance r is increased and an overattenuation is caused. Thus, it is possible to detect a characteristic residual vibration waveform (see "dry" in FIG. 5).

In the case in which paper dust or dust adheres to a nozzle surface, the ink soaks out of the nozzle due to the paper dust so that the weight of the ink seen from the vibrating plate is increased and the inertance m is increased. Moreover, the acoustic resistance r is increased by the fiber of the paper dust adhering to the nozzle and a period becomes longer than a period for a normal discharge (a frequency is reduced). Thus, it is possible to detect a characteristic residual vibration waveform (see "paper dust" in FIG. 5).

From the foregoing, the discharge abnormality of the ink droplets of the inkjet head 20 can be detected from a difference in the residual vibration of the vibrating plate 21, and furthermore, the cause of the clogging can be specified.

The invention serves to detect the residual vibration of the vibrating plate 21, thereby detecting the discharge abnormality of the ink droplets of the inkjet head 20 (the discharge abnormality of the nozzle), and the detection principle of the residual vibration will be described with reference to FIGS. 6 and 7.

Figure 6:
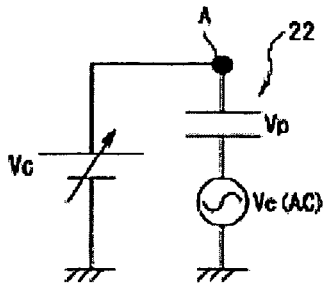
FIG. 6 is a diagram showing an equivalent circuit for explaining the detection principle of the residual vibration of the vibrating plate according to the invention, which is obtained immediately after the application of a driving signal.

FIG. 6 shows a driving voltage obtained immediately after a driving signal is applied from a driving circuit which will be described below to the piezoelectric actuator 22, and an equivalent circuit of the piezoelectric actuator 22 at this time. The driving signal is output by setting an intermediate voltage Vc to be a reference as shown in FIG. 11(A). For this reason, the intermediate potential Vc is output immediately after the application of the driving signal. At this time, a voltage Vp to be charged to the capacitor component of the piezoelectric actuator 22 to be a piezoelectric unit is charged to have almost the intermediate potential Vc.

On the other hand, an electromotive voltage Ve of the piezoelectric actuator 22 related to the residual vibration of the vibrating plate 21 which is generated after the application of the driving signal is changed in an alternating manner based on a DC voltage to be the charging voltage Vp. In this state, however, the voltage of a terminal A of the piezoelectric actuator 22 is controlled to be the intermediate potential Vc by a driving circuit which will be described below, and a voltage fluctuating component of the electromotive force Ve is attenuated (focused) to the intermediate potential Vc in a comparatively short time. For this reason, the electromotive force Ve related to the residual vibration of the vibrating plate 21 cannot be detected effectively.

Figure 7:
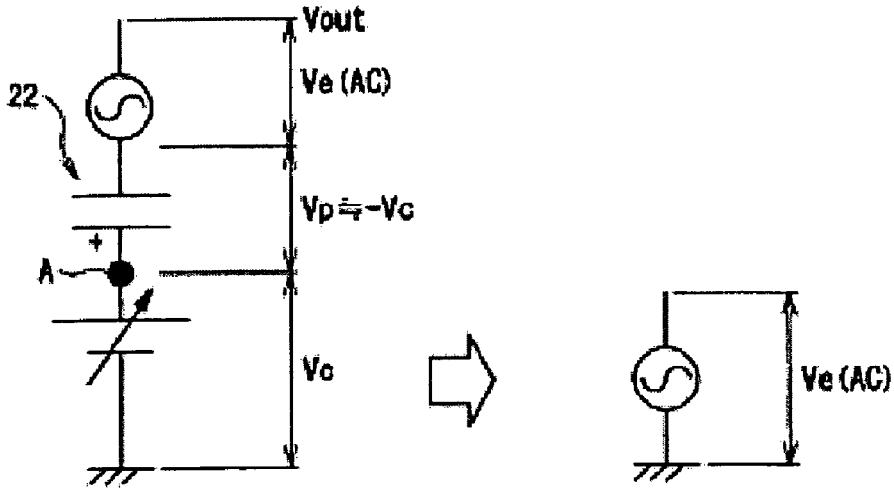
FIG. 7 is a circuit diagram showing the equivalent circuit in the detection of the residual vibration.

When a terminal on the ground side of the piezoelectric actuator 22 is separated from a ground after the application of the driving signal, the equivalent circuit is obtained as shown in FIG. 7 in this case. Referring to FIG. 7, the relationship between the voltages of portions is shown, and a voltage Vout is calculated in Equation (4).

$$Vout=Vc+Vp+Ve=Vc-Vc+Ve=Ve \quad (4)$$

According to the Equation (4), the intermediate potential Vc of the driving signal is cancelled by the charging voltage Vp of the piezoelectric actuator 22. By detecting a change in a voltage between the terminal on the ground side of the piezoelectric actuator 22 and the ground as shown in FIG. 7, accordingly, it is possible to detect the electromotive voltage Ve of the piezoelectric actuator 22 which is generated by the residual vibration of the vibrating plate 21.

More specifically, by floating the terminal on the ground side of the piezoelectric actuator 22 from the ground after the operation for discharging ink droplets from the nozzle 24, it is possible to implement a state shown in FIG. 7. Therefore, it is possible to detect the electromotive voltage Ve of the piezoelectric actuator 22 which is generated corresponding to the residual vibration of the vibrating plate 21 without the influence of the intermediate potential Vc. Accordingly, it is possible to drop the breakdown voltage of a switching unit for turning ON/OFF the connection of the terminal on the ground side of the piezoelectric actuator 22 to the ground as will be described below.

Referring to FIGS. 2 and 8 to 10, next, description will be given to a first embodiment of the invention in which the residual vibration is detected when the detection of the discharge abnormality of each nozzle of the inkjet head 20 (the dot dropouts of the nozzle) is required based on the detection principle of the residual vibration.

Figure 8:
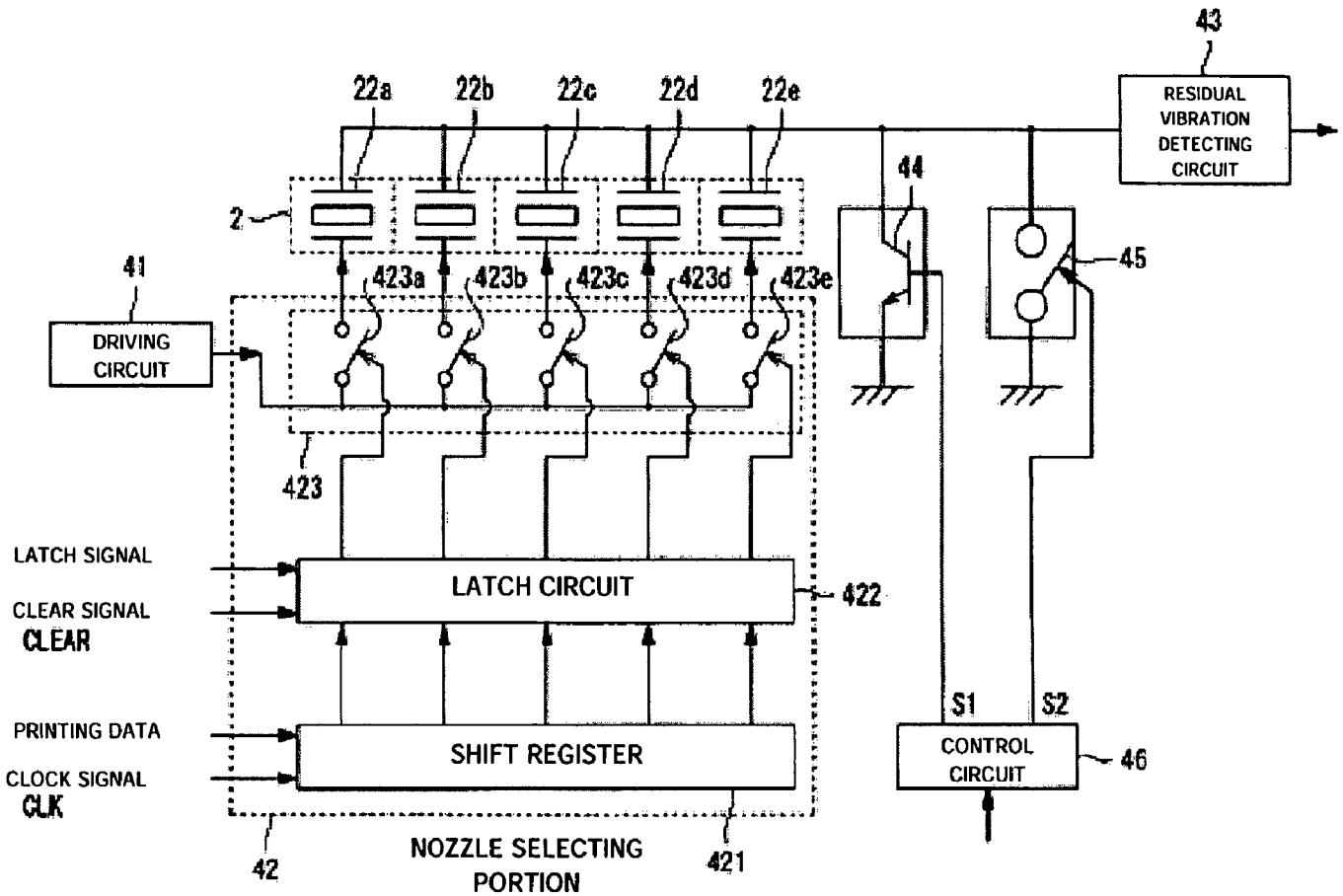
FIG. 8 is a block diagram showing a structure according to the first embodiment of the invention.

In the first embodiment, as shown in FIG. 8, there are provided at least a plurality of piezoelectric actuators 22*a* to 22*e*, a driving circuit 41 to be a driving unit, a nozzle selecting portion 42 to be a nozzle selecting unit, a residual vibration detecting circuit 43 to be a residual vibration detecting unit, a transistor 44 to be a first switch unit, a switch 45 to be a second switch unit, and a control circuit 46 to be a switch control unit.

The piezoelectric actuators 22*a* to 22*e* correspond to the piezoelectric actuator 22 provided for each nozzle 24 of the inkjet head 20 (see FIG. 2) provided in the head unit 2 shown in FIG. 1.

The driving circuit 41 serves to output a driving signal (a driving voltage) for driving the piezoelectric actuators 22*a* to 22*e* and outputs a driving signal (see FIG. 11(A)) which will be described below.

The piezoelectric actuators 22*a* to 22*e* are constituted by piezo units, for example, and carry out a displacement by a voltage applied between both electrodes, and the driving signal shown in FIG. 11(A) is applied from the driving circuit 41. For this reason, the piezoelectric actuators 22*a* to 22*e* are always charged in the vicinity of the intermediate potential Vc during the operation, and are charged/discharged every time the driving signal is applied (output) from the driving circuit 41. By applying a pressure to the ink in the corresponding cavity 23 in the charge/discharge, accordingly, the ink droplets are discharged from the nozzle 24.

The nozzle selecting portion 42 serves to select the nozzles 24 of the inkjet heads 20 and to supply the driving signal from the driving circuit 41 to the piezoelectric actuators 22*a* to 22*e* corresponding to the nozzle 24 thus selected, respectively. For this reason, the nozzle selecting portion 42 includes a shift register 421, a latch circuit 422 and a driver 423 as shown in FIG. 8.

The shift register 421 serves to sequentially input and store printing data output from a system controller (not shown) for controlling the operation of the whole inkjet printer. More specifically, the printing data are sequentially shifted (transferred) from a flip-flop in an initial stage of the shift register 421 to a flip-flop on a subsequent stage side synchronously with a clock signal CLK.

When printing data corresponding to the number of the nozzles 24 in the head unit 2, that is, five nozzles 24 in this example are stored in the shift register 421, the latch circuit 422 temporarily latches (stores) the stored contents of each flip-flop in the shift register 421 in response to a latch signal. At this time, accordingly, the printing data are subjected to a serial-parallel conversion.

When a clear signal CLEAR is input to the latch circuit 422, a latch state is cancelled so that contents thereof are set to be "0" and the printing operation is stopped. On the other hand, when the clear signal CLEAR is not input to the latch circuit 422, the printing data of the shift register 421 which are latched are output to the driver 423.

After the printing data of the shift register 421 are latched to the latch circuit 422, next printing data are input to the shift register 421 to sequentially update the contents of the latch signal of the latch circuit 422 in a print timing.

The driver 423 serves to selectively supply the output signal of the driving circuit 41 to the piezoelectric actuators 22*a* to 22*e* which are specified by the latch signal sent from the latch circuit 422. For this reason, the driver 423 includes switches 423*a* to 423*e* which are constituted by switching units (transistors) connected to the piezoelectric actuators 22*a* to 22*e* as shown in FIG. 8, and the switches 423*a* to 423*e* are ON/OFF operated in response to corresponding latch signals sent from the latch circuit 422.

In more detail, each of the switches 423*a* to 423*e* has a terminal on one end side which is connected in common, and the common connecting portions are connected to the output side of the driving circuit 41. Moreover, each of terminals on the other end side of the switches 423*a* to 423*e* is connected to an electrode on one end side of each of the piezoelectric actuators 22*a* to 22*e* corresponding thereto.

The residual vibration detecting circuit 43 serves to detect, as a residual vibration, each of the electromotive voltages of the piezoelectric actuators 22*a* to 22*e* which are generated corresponding to the residual vibration of the vibrating plate 21 by the detection principle of the residual vibration when the discharge abnormality of the nozzle (the discharge abnormality of the ink droplets) is to be detected. For this reason, the input side of the residual vibration detecting circuit 43 is connected to each of electrodes on the other end side of the piezoelectric actuators 22*a* to 22*e* (each of electrodes on the ground side).

The transistor 44 is a switching unit for connecting each of the electrodes on the ground side of the piezoelectric actuators 22*a* to 22*e* to the ground, and has a large current capacitance capable of causing a sufficient current to flow even if the piezoelectric actuators 22*a* to 22*e* are driven at the same time in the connection.

The transistor 44 has a collector connected to a common connecting portion to which the electrodes on the ground side of the piezoelectric actuators 22*a* to 22*e* are connected in common, and has an emitter connected to the ground, and a driving/detection changeover signal S1 (see FIG. 11(C)) is supplied from the control circuit 46 to a base. Therefore, the transistor 44 is ON/OFF controlled in response to the driving/detection changeover signal S1. Consequently, each of the electrodes on the ground side of the piezoelectric actuators 22*a* to 22*e* is connected to the ground or is not connected thereto.

The transistor 44 can be replaced with various switching units such as an MOS transistor, a thyristor and a triac.

The switch 45 is a switching unit such as an analog switch for connecting each of the electrodes on the ground side of the piezoelectric actuators 22*a* to 22*e* to the ground when detecting the discharge abnormality of the nozzle, and has a small current capacitance capable of causing a sufficient current to flow when one of the piezoelectric actuators 22*a* to 22*e* is driven.

The switch 45 has one of terminals connected to a common connecting portion to which each of the electrodes on the ground side of the piezoelectric actuators 22*a* to 22*e* is connected in common and the other terminal connected to the ground, and a contact thereof is ON/OFF controlled in response to a detection timing signal S2 (see FIG. 11(D)) output from the control circuit 46.

For the switch 45, it is possible to use various switching units such as a bipolar transistor, an MOS transistor, a thyristor and a triac in addition to the analog switch. Moreover, the switching speed of the switch 45 is higher than that of the transistor 44.

The control circuit 46 serves to generate the driving/detection changeover signal S1 for ON/OFF controlling the transistor 44 and the detection timing signal S2 for ON/OFF controlling the switch 45 and to output both of the signals as will be described below in case of a printing operation or an operation for detecting the discharge abnormality of a nozzle based on an instruction sent from a system controller (not shown).

Figure 9:
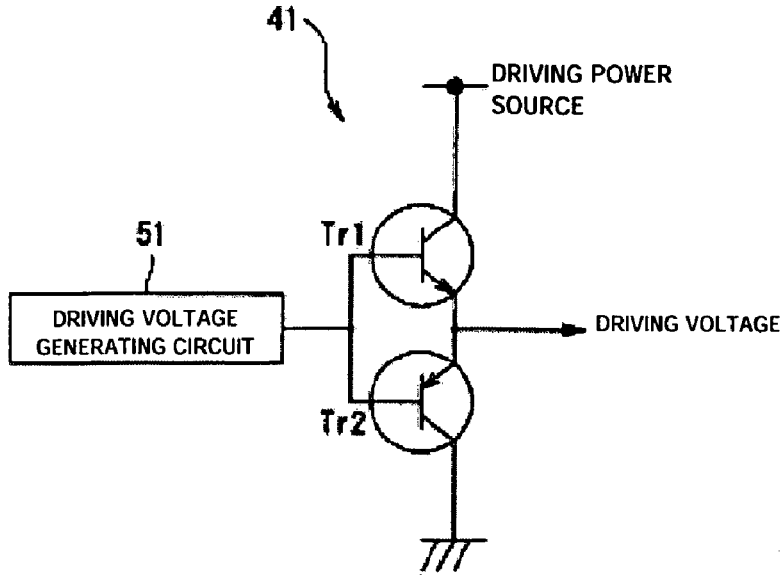
FIG. 9 is a circuit diagram showing the specific structure of a driving circuit illustrated in FIG. 8.

Next, the specific structure of the driving circuit 41 shown in FIG. 8 will be described with reference to FIG. 9.

The driving circuit 41 is constituted by a driving voltage generating circuit 51 and a current amplifying circuit obtained by combining an NPN transistor Tr1 and a PNP transistor Tr2 as shown in FIG. 8.

The transistor Tr1 has a collector connected to a constant voltage source (a driving power source) which is not shown, a base connected to the output side of the driving voltage generating circuit 51, and an emitter connected to each of the terminals on one side of the switches 423*a* to 423*e* in the driver 423, respectively. Consequently, the transistor Tr1 is conducted based on a driving signal sent from the driving voltage generating circuit 51 so that a driving voltage is supplied to the corresponding piezoelectric actuators 22*a* to 22*e* through the switches 423*a* to 423*e*.

Moreover, the transistor Tr2 has an emitter connected to the emitter of the transistor Tr1 and connected to each of the terminals on one side of the switches 423*a* to 423*e*, a base connected to the output side of the driving voltage generating circuit 51, and a collector connected to a ground. Consequently, the transistor Tr2 is conducted based on the driving signal sent from the driving voltage generating circuit 51 and discharges each of the electric charges of the piezoelectric actuators 22*a* to 22*e* through the switches 423*a* to 423*e*.

Next, an example of the specific structure of the residual vibration detecting circuit 43 shown in FIG. 8 will be described with reference to FIG. 10.

Figure 10:
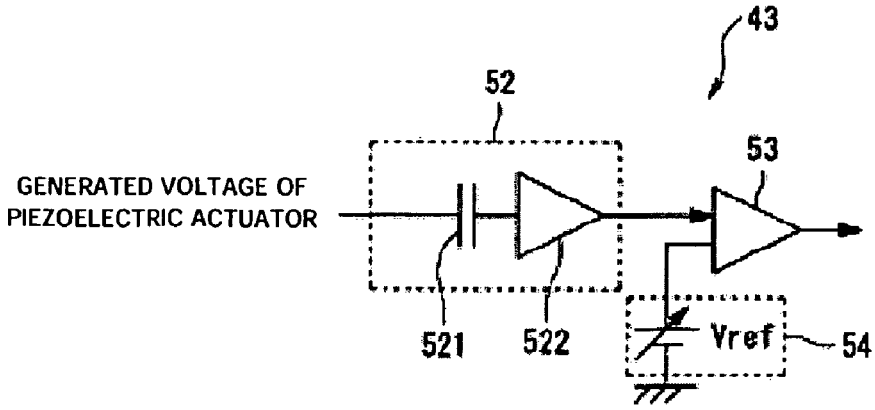
FIG. 10 is a block diagram showing the specific structure of a residual vibration detecting circuit illustrated in FIG. 8.

The residual vibration detecting circuit 43 includes an alternating current amplifier 52, a comparator 53 and a reference voltage generating circuit 54 as shown in FIG. 10.

The alternating current amplifier 52 serves to amplify each of the electromotive voltages of the piezoelectric actuators 22*a* to 22*e*, that is, the AC component of a residual vibration waveform generated by the mechanical change of the vibrating plate 21. For this reason, the alternating current amplifier 52 includes a capacitor 521 for cutting a DC component contained in each of voltages generated in the piezoelectric actuators 22*a* to 22*e*, and an amplifier 522 for amplifying an AC component from which the DC component is cut by the capacitor 521.

The comparator 53 serves to compare a voltage output from the alternating current amplifier 52 with a reference voltage Vref generated from the reference voltage generating circuit 54, and outputs, as a residual vibration waveform, a pulse waveform voltage corresponding to the result of the comparison. The reference voltage generating circuit 54 serves to generate the reference voltage Vref to be supplied to the comparator 53. The reference voltage Vref to be generated may have a fixed value or may be variable and set to have an optional value.

Figure 11:
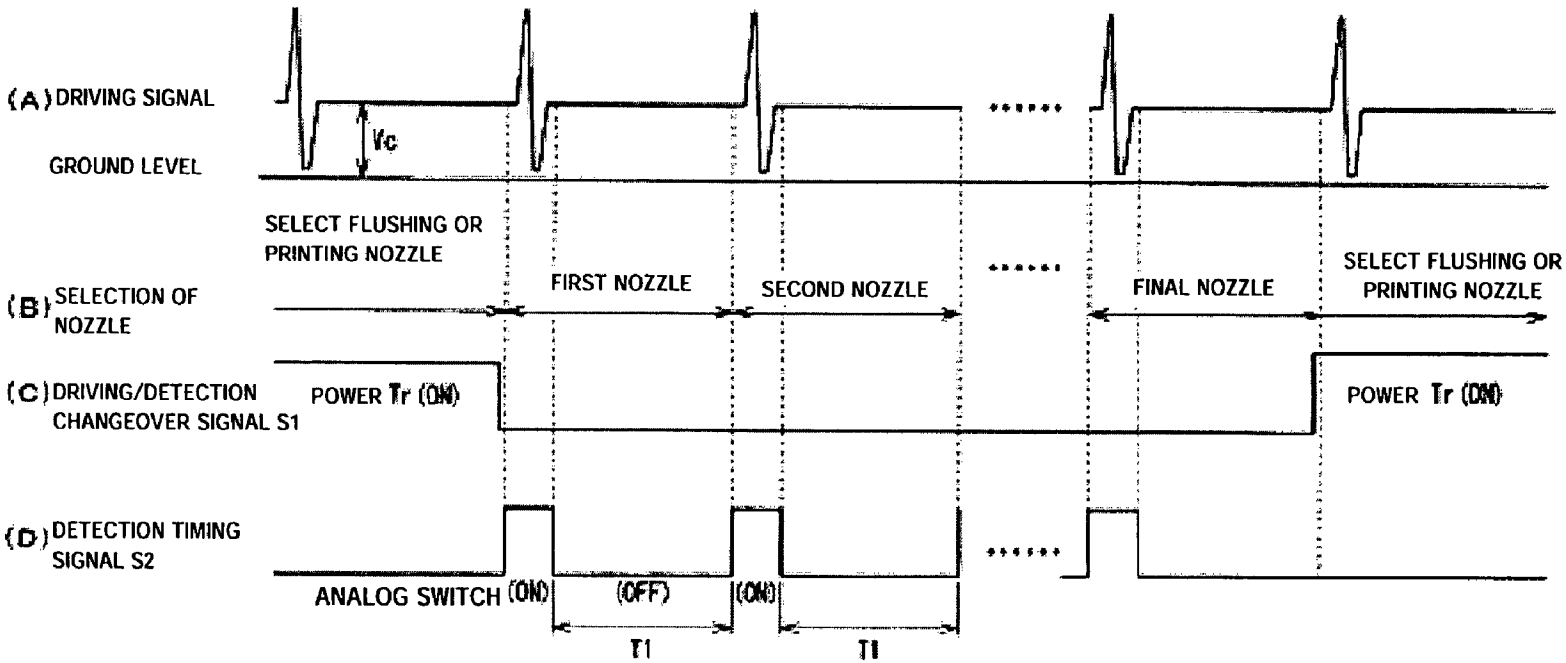
FIG. 11 is a waveform diagram showing an example of the waveform of each portion according to the first embodiment illustrated in FIG. 8.
Figure 12:
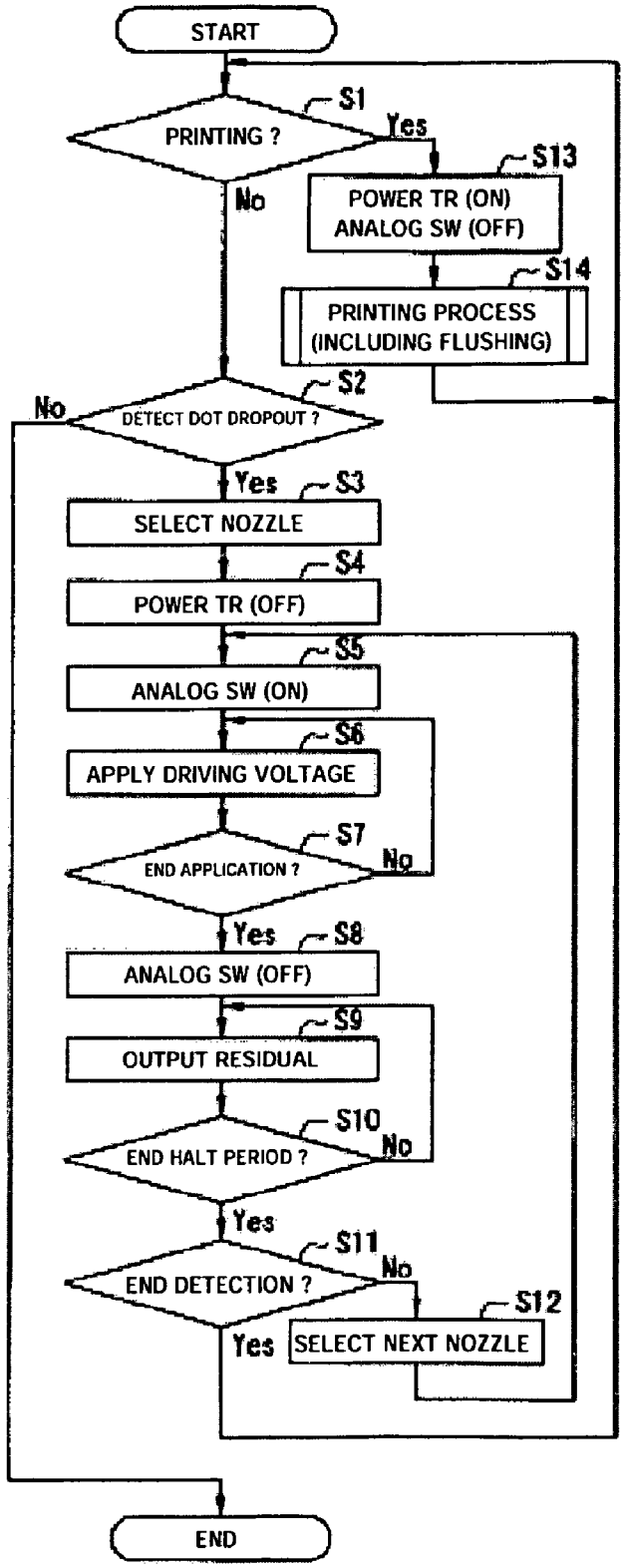
FIG. 12 is a flowchart for explaining an operation according to the first embodiment illustrated in FIG. 8.

Next, an example of the operation according to the first embodiment having such a structure will be described with reference to FIGS. 8, 11 and 12.

When an instruction for printing is given from the system controller (not shown) (Step S1: YES), a processing proceeds to Step S13. At the Step S13, the power transistor 44 is turned ON and the switch 45 to be the analog switch is turned OFF.

More specifically, at this time, the driving/detection changeover signal S1 output from the control circuit 46 shown in FIG. 8 is set to have an "H level" (see FIG. 11(C)) and the detection timing signal S2 output from the control circuit 46 is set to have an "L level" (see FIG. 11(D)). Consequently, the power transistor 44 is turned ON and the switch 45 is turned OFF.

In this state, the driving signal shown in FIG. 11(A) is output from the driving circuit 41. The driving signal is constituted by a pulse waveform changed to positive and negative based on the intermediate potential Vc as shown. Prior thereto, the nozzle selecting portion 42 selects the nozzles 24 of the inkjet heads 20 based on printing data. For this reason, the driving signal is supplied from the driving circuit 41 to the piezoelectric actuators 22*a* to 22*e* corresponding to the nozzles 24 thus selected, respectively. Therefore, the piezoelectric actuators 22*a* to 22*e* are driven so that ink droplets are discharged, onto a recording paper, from the corresponding nozzles 24 of the inkjet heads 20 and a printing process is thus carried out (Step S14). The printing process includes flushing.

On the other hand, when an instruction for detecting the discharge abnormality of the nozzle (the detection of dot dropouts) is given from the system controller (Step S2: YES), the processing proceeds to Step S3 in which the nozzle 24 to be a check object is selected. In this case, data for nozzle selection are input from the system controller to the shift register 421 of the nozzle selecting portion 42 shown in FIG. 8. Consequently, the switch 423*a* of the driver 423 is turned ON in order to drive the piezoelectric actuator 22*a* corresponding to the first nozzle 24, for example.

As shown in FIG. 11(C), then, the driving/detection changeover signal is changed from the "H level" to the "L level" so that the transistor (power transistor) 44 is turned OFF (Step S4), and the detection timing signal is changed from the "L level" to the "H level" so that the switch 45 is turned ON (Step S5).

When the driving signal shown in FIG. 11(A) is output from the driving circuit 41 in this state, a driving voltage taking the shape of a pulse which is changed to positive and negative based on the intermediate potential Vc is applied to the piezoelectric actuator 22*a* (Step S6). When the application of the driving voltage is ended (Step S7: YES), then, the detection timing signal S2 is changed from the "H level" to the "L level" so that the switch 45 is turned OFF and a halt period T1 in which the discharge of the ink from the nozzle is halted is started as shown in FIG. 11(D).

For the halt period T1, the electromotive voltage of the piezoelectric actuator 22*a* which is obtained by the residual vibration of the vibrating plate 21 is output as described in the detection principle of the residual vibration (Step S9). Therefore, the residual vibration detecting circuit 43 detects the electromotive voltage.

When the halt period T1 is ended (Step S10: YES), thereafter, the detection of the discharge abnormality of the nozzle has not been ended at this time (Step S11: NO), and therefore, a next nozzle (a second nozzle) is selected (Step S12). When the second nozzle is selected in the same manner as the first nozzle, the switch 423*b* of the driver 423 is turned ON in order to drive the piezoelectric actuator 22*b* corresponding to the second nozzle.

As shown in FIG. 11(D), then, the detection timing signal is changed from the "L level" to the "H level" so that the switch 45 is turned ON (Step S5). When the driving signal shown in FIG. 11(A) is output from the driving circuit 41 in this state, a driving voltage is applied to the piezoelectric actuators 22*b* (Step S6). When the application of the driving voltage is ended (Step S7: YES), thereafter, the detection timing signal is changed from the "H level" to the "L level" so that the switch 45 is turned OFF and the halt period T1 is restarted as shown in FIG. 11(D).

For the halt period T1, the electromotive voltage Ve of the piezoelectric actuator 22*b* which is obtained by the residual vibration of the vibrating plate 21 is output (Step S9). Therefore, the residual vibration detecting circuit 43 detects the electromotive voltage.

When the halt period T1 is ended (Step S10: YES), then, a next nozzle (a third nozzle) is selected and the residual vibration detecting circuit 43 detects the electromotive voltage of the piezoelectric actuator 22*c* by the residual vibration of the vibrating plate 21 in the same procedure described above.

When a final nozzle is selected and the residual vibration detecting circuit 43 detects the electromotive voltage of the piezoelectric actuator 22*e* which is obtained by the residual vibration of the vibrating plate 21 in the same procedure, thereafter, the processing of detecting the discharge abnormality of the nozzle is ended (Step S11: YES).

The output voltage of the residual vibration detecting circuit 43 is supplied to a waveform deciding circuit (not shown) connected to a subsequent stage as described above. Consequently, the waveform deciding circuit decides the presence of the discharge abnormality of the ink droplets based on the waveform of the output voltage and specifies the contents of the abnormality (the cause of the clogging of an ink).

As described above, according to the first embodiment of the invention, a special sensor such as an optical sensor is not required, and furthermore, the reliability of precision in the detection of the discharge abnormality of ink droplets can be enhanced by a comparatively simple structure.

According to the first embodiment of the invention, moreover, a switching unit such as a power transistor having a large current capacitance can be used in printing and an analog switch capable of being turned ON/OFF with a small current capacitance at a high speed can be used in the detection of the discharge abnormality of a nozzle. Consequently, it is possible to accurately detect the residual vibration of the vibrating plate which is generated after the supply of a driving signal to the piezoelectric actuator.

Second Embodiment

Figure 13:
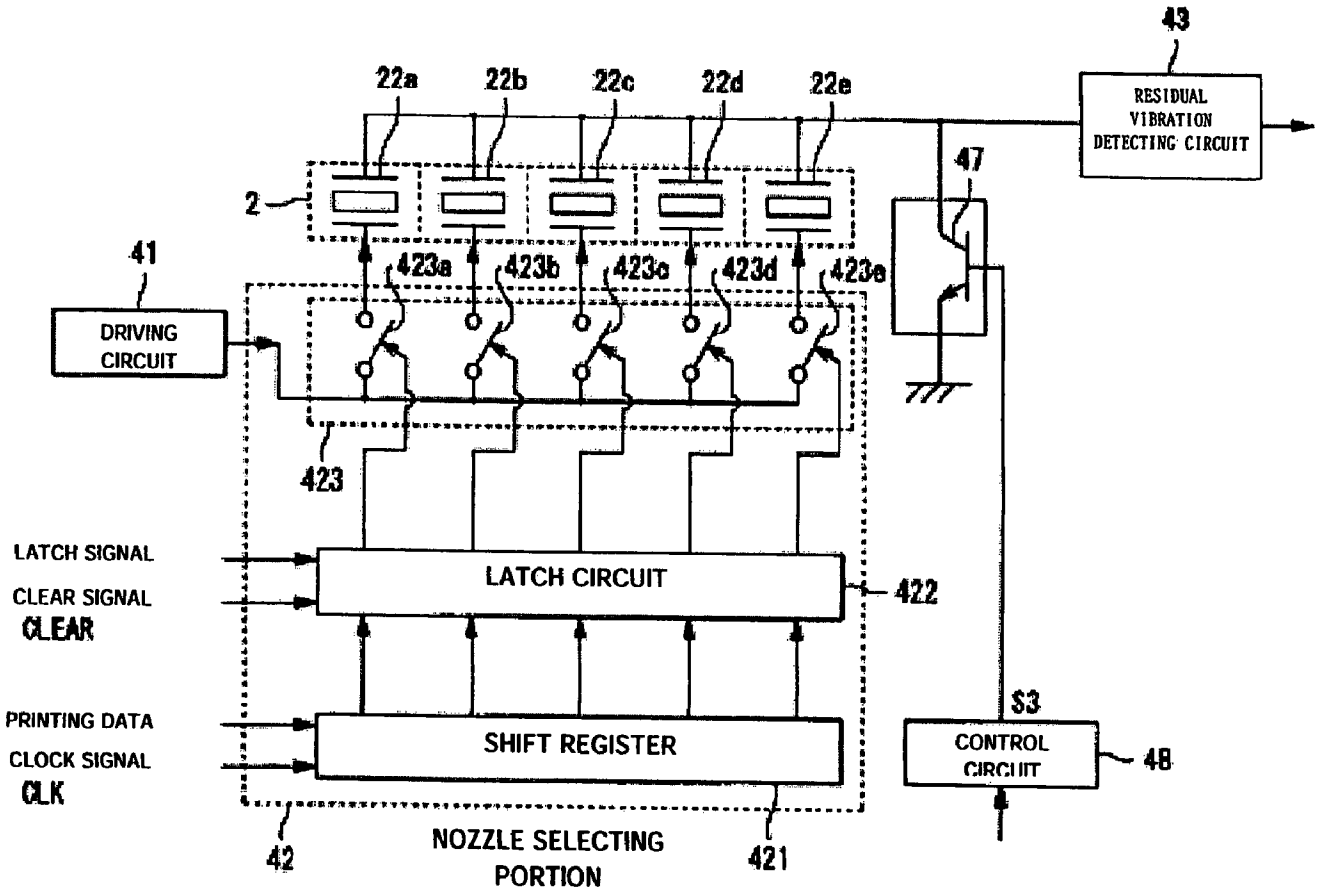
FIG. 13 is a block diagram showing a structure according to a second embodiment of the invention.

Referring to FIGS. 2 and 13, next, description will be given to a second embodiment of the invention in which the detection of a residual vibration is carried out when the discharge abnormality of each nozzle of each inkjet head 20 (the dot dropouts of the nozzle) is to be detected based on the detection principle of the residual vibration described above.

In the second embodiment, as shown in FIG. 13, there are provided at least a plurality of piezoelectric actuators 22*a* to 22*e*, a driving circuit 41 to be a driving unit, a nozzle selecting portion 42 to be a nozzle selecting unit, a residual vibration detecting circuit 43 to be a residual vibration detecting unit, a transistor 47 to be a switch unit, and a control circuit 48 to be a switch control unit.

More specifically, a structure according to the second embodiment has common components to the structure according to the first embodiment shown in FIG. 8, and is different in that the transistor 44 and the switch 45 in the first embodiment are replaced with the transistor 47, and with the replacement, the control circuit 46 in the first embodiment is replaced with the control circuit 48.

The piezoelectric actuators 22*a* to 22*e* correspond to the piezoelectric actuator 22 provided for each nozzle 24 of the inkjet head 20 (see FIG. 2) provided in the head unit 2 shown in FIG. 1.

The driving circuit 41 serves to output a driving signal (a driving voltage) for driving the piezoelectric actuators 22*a* to 22*e* and outputs a driving signal (see FIG. 14(A)) which will be described below. The driving circuit 41 is constituted in the same manner as the driving circuit 41 according to the first embodiment shown in FIG. 9.

The piezoelectric actuators 22*a* to 22*e* are constituted by piezo units, for example, and serve to carry out a displacement by a voltage applied between both electrodes, and the driving signal shown in FIG. 14(A) is applied from the driving circuit 41. For this reason, the piezoelectric actuators 22*a* to 22*e* are always charged in the vicinity of an intermediate potential Vc during the operation, and are charged/discharged every time the driving signal is applied (output) from the driving circuit 41. By applying a pressure to the ink in a corresponding cavity 23 in the charge/discharge, accordingly, the ink droplets are discharged from the nozzle 24.

The nozzle selecting portion 42 serves to select the nozzles 24 of the inkjet heads 20 and to supply the driving signal from the driving circuit 41 to the piezoelectric actuators 22*a* to 22*e* corresponding to the nozzle 24 thus selected, respectively. For this reason, the nozzle selecting portion 42 includes a shift register 421, a latch circuit 422 and a driver 423 as shown in FIG. 13.

The shift register 421 serves to sequentially input and store printing data output from a system controller (not shown) for controlling the operation of the whole inkjet printer. More specifically, the printing data are sequentially shifted (transferred) from a flip-flop in an initial stage of the shift register 421 to a flip-flop on a subsequent stage side synchronously with a clock signal CLK.

When printing data corresponding to the number of the nozzles 24 in a head unit 2, that is, five nozzles 24 in this example are stored in the shift register 421, the latch circuit 422 temporarily latches (stores) the stored contents of each flip-flop in the shift register 421 in response to a latch signal.

When a clear signal CLEAR is input to the latch circuit 422, a latch state is cancelled so that contents thereof are set to be "0" and the printing operation is stopped. On the other hand, when the clear signal CLEAR is not input to the latch circuit 422, the printing data of the shift register 421 which are latched are output to the driver 423.

After the printing data of the shift register 421 are latched to the latch circuit 422, next printing data are input to the shift register 421 to sequentially update the contents of the latch signal of the latch circuit 422 in a print timing.

The driver 423 serves to selectively supply the output signal of the driving circuit 41 to the piezoelectric actuators 22*a* to 22*e* which are specified by the latch signal sent from the latch circuit 422. For this reason, the driver 423 includes switches 423*a* to 423*e* which are constituted by switching units (transistors) connected to the piezoelectric actuators 22*a* to 22*e* as shown in FIG. 13, and the switches 423*a* to 423*e* are ON/OFF operated in response to corresponding latch signals sent from the latch circuit 422.

In more detail, each of the switches 423*a* to 423*e* has a terminal on one end side which is connected in common, and the common connecting portion is connected to the output side of the driving circuit 41. Moreover, each of terminals on the other end side of the switches 423*a* to 423*e* is connected to an electrode on one end side of each of the piezoelectric actuators 22*a* to 22*e* corresponding thereto.

The residual vibration detecting circuit 43 serves to detect, as a residual vibration, each of electromotive voltages of the piezoelectric actuators 22*a* to 22*e* which are generated corresponding to the residual vibration of a vibrating plate 21 by the detection principle of the residual vibration when the discharge abnormality of the nozzle (the discharge abnormality of the ink droplets) is to be detected. For this reason, the input side of the residual vibration detecting circuit 43 is connected to each of electrodes on the other end side of the piezoelectric actuators 22*a* to 22*e* (each of electrodes on the ground side). The residual vibration detecting circuit 43 is constituted in the same manner as the residual vibration detecting circuit 43 according to the first embodiment shown in FIG. 10.

The transistor 47 is a switching unit for connecting each of the electrodes on the ground side of the piezoelectric actuators 22*a* to 22*e* to the ground, and is formed by a power transistor having a large current capacitance which can cause a sufficient current for carrying out the driving operation to flow even if the piezoelectric actuators 22*a* to 22*e* are driven at the same time in the connection.

The transistor 47 has a collector connected to a common connecting portion to which the electrodes on the ground side of the piezoelectric actuators 22*a* to 22*e* are connected in common, and has an emitter connected to the ground, and a driving/detection changeover signal S3 (see FIG. 14(C)) is supplied from the control circuit 48 to a base. Therefore, the transistor 47 is ON/OFF controlled in response to the driving/detection changeover signal S3. Consequently, each of the electrodes on the ground side of the piezoelectric actuators 22*a* to 22*e* is connected to the ground or is not connected thereto.

The transistor 47 can be replaced with various switching units such as an MOS transistor, a thyristor and a triac.

The control circuit 48 serves to generate and output the driving/detection changeover signal S3 for ON/OFF controlling the transistor 47 as will be described below in case of a printing operation or an operation for detecting the discharge abnormality of a nozzle based on an instruction sent from a system controller (not shown).

Figure 14:
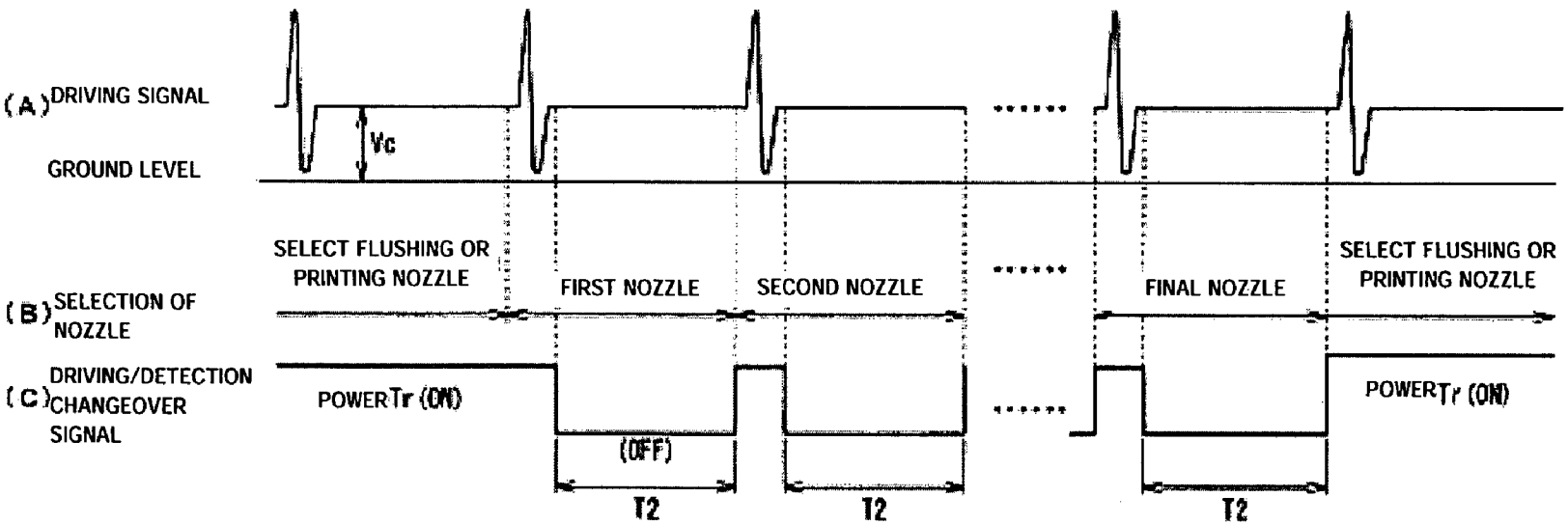
FIG. 14 is a waveform diagram showing an example of the waveform of each portion according to the second embodiment illustrated in FIG. 13.
Figure 15:
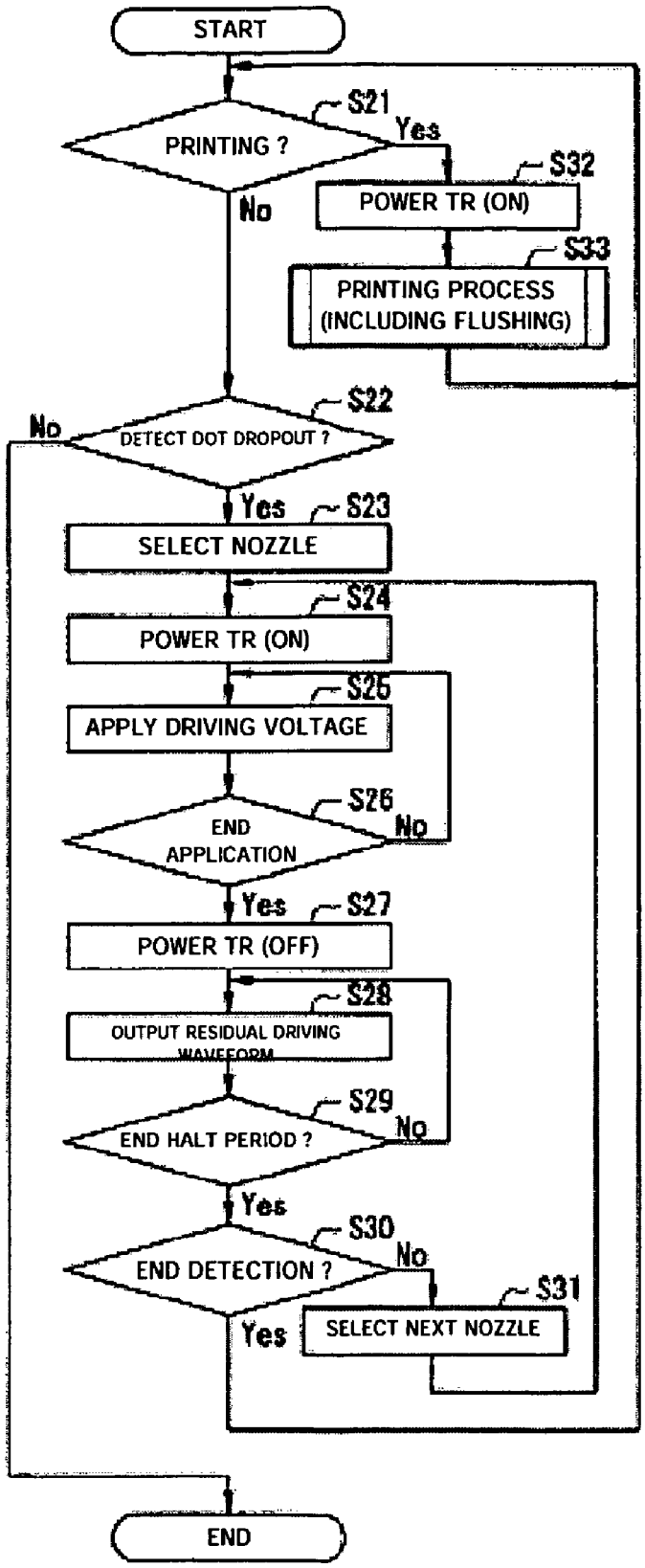
FIG. 15 is a flowchart for explaining an operation according to the second embodiment illustrated in FIG. 13.

Next, an example of the operation according to the second embodiment having such a structure will be described with reference to FIGS. 13 to 15.

When an instruction for printing is given from the system controller (not shown) (Step S21: YES), a processing proceeds to Step S32. At the Step S32, the transistor (the power transistor) 47 is turned ON. More specifically, since the driving/detection changeover signal S3 output from the control circuit 48 shown in FIG. 13 is set to have an "H level" (see FIG. 14(C)) at this time, the transistor 47 is turned ON.

In this state, the driving signal shown in FIG. 14(A) is output from the driving circuit 41. The driving signal is constituted by a pulse waveform changed to positive and negative based on the intermediate potential Vc as shown. Prior thereto, the nozzle selecting portion 42 selects the nozzles 24 of the inkjet heads 20 based on printing data.

For this reason, the driving signal is supplied from the driving circuit 41 to the piezoelectric actuators 22*a* to 22*e* corresponding to the nozzles 24 thus selected, respectively. Therefore, the piezoelectric actuators 22*a* to 22*e* are driven so that ink droplets are discharged, onto a recording paper, from the corresponding nozzles 24 of the inkjet heads 20 and a printing process is thus carried out (Step S33). The printing process includes flushing.

On the other hand, when an instruction for detecting the discharge abnormality of the nozzle (the detection of dot dropouts) is given from the system controller (Step S22: YES), the processing proceeds to Step S23 in which the nozzle 24 to be a check object is selected. In this case, data for nozzle selection are input from the system controller to the shift register 421 of the nozzle selecting portion 42 shown in FIG. 13. Consequently, the switch 423*a* of the driver 423 are turned ON in order to drive the piezoelectric actuator 22*a* corresponding to the first nozzle 24, for example.

Since the driving/detection changeover signal S3 has the "H level" as shown in FIG. 14(C) at this time, the transistor 47 is ON (Step S24).

When the driving signal shown in FIG. 14(A) is output from the driving circuit 41 in this state, a driving voltage taking the shape of a pulse which is changed to positive and negative based on the intermediate potential Vc is applied to the piezoelectric actuator 22*a* (Step S25). When the application of the driving voltage is ended (Step S26: YES), the driving/detection changeover signal S3 is changed from the "H level" to an "L level" so that the transistor 47 is turned OFF and a halt period T2 in which the discharge of the ink from the nozzle is halted is started as shown in FIG. 14(C).

For the halt period T2, the electromotive voltage of the piezoelectric actuator 22*a* which is obtained by the residual vibration of the vibrating plate 21 is output as described in the detection principle of the residual vibration (Step S28). Therefore, the residual vibration detecting circuit 43 detects the electromotive voltage.

When the halt period T2 is ended (Step S29: YES), thereafter, the detection of the discharge abnormality of the nozzle has not been ended at this time (Step S30: NO), and therefore, a next nozzle (a second nozzle) is selected (Step S31). When the second nozzle is selected in the same manner as the first nozzle, the switch 423*b* of the driver 423 is turned ON in order to drive the piezoelectric actuator 22*b* corresponding to the second nozzle.

As shown in FIG. 14(C), then, the driving/detection changeover signal S3 is changed from the "L level" to the "H level" so that the transistor 47 is turned ON (Step S24). When the driving signal shown in FIG. 14(A) is output from the driving circuit 41 in this state, a driving voltage is applied to the piezoelectric actuators 22*b* (Step S25). When the application of the driving voltage is ended (Step S26: YES), thereafter, the driving/detection changeover signal S3 is changed from the "H level" to the "L level" so that the transistor 47 is turned OFF and the halt period T2 is restarted as shown in FIG. 14(C).

For the halt period T2, an electromotive voltage Ve of the piezoelectric actuator 22*b* which is obtained by the residual vibration of the vibrating plate 21 is output (Step S28). Therefore, the residual vibration detecting circuit 43 detects the electromotive voltage.

When the halt period T2 is ended (Step S29: YES), then, a next nozzle (a third nozzle) is selected and the residual vibration detecting circuit 43 detects the electromotive voltage of the piezoelectric actuator 22*c* by the residual vibration of the vibrating plate 21 in the same procedure described above.

When a final nozzle is selected and the residual vibration detecting circuit 43 detects the electromotive voltage of the piezoelectric actuator 22*e* which is obtained by the residual vibration of the vibrating plate 21 in the same procedure, thereafter, the processing of detecting the discharge abnormality of the nozzle is ended (Step S30: YES).

The output voltage of the residual vibration detecting circuit 43 is supplied to a waveform deciding circuit (not shown) connected to the subsequent stage as described above. Consequently, the waveform deciding circuit decides the presence of the discharge abnormality of the ink droplets based on the waveform of the output voltage and specifies the contents of the abnormality (the cause of the clogging of an ink).

As described above, according to the second embodiment of the invention, a special sensor such as an optical sensor is not required, and furthermore, the reliability of precision in the detection of the discharge abnormality of ink droplets can be enhanced by a comparatively simple structure.

According to the second embodiment of the invention, moreover, the transistor 44 and the switch 45 in the first embodiment are replaced with the transistor 47, and with the replacement, the control circuit 46 in the first embodiment is replaced with the control circuit 48. Therefore, a structure and a control can be more simplified as compared with the first embodiment.

In each of the embodiments, the piezoelectric actuator 22 of the lamination type in which the piezoelectric units are provided is used for the inkjet head 20 as shown in FIG. 2. For the piezoelectric actuator, however, it is possible to use various actuators utilizing a piezoelectric unit, for example, a unimorph actuator using a piezo system and a share mode actuator using the piezo system in addition to the actuator of the lamination type using the piezo system shown in FIG. 2.

What is claimed is:

1. A droplet discharging device comprising:

a head unit including:

a plurality of droplet discharging heads having a vibrating plate;

a piezoelectric actuator for displacing the vibrating plate;

a cavity filled with a liquid and having a pressure in an inner part which is increased and decreased by the displacement of the vibrating plate; and a nozzle communicating with the cavity and serving to discharge the liquid as droplets by the increase and decrease in the pressure in the inner part;

a driving unit for outputting a driving signal to drive each of the piezoelectric actuators of the droplet discharging heads;

a nozzle selecting unit for selecting each of the nozzles of the droplet discharging heads and supplying the driving signal from the driving unit to the piezoelectric actuator corresponding to the nozzle thus selected;

a residual vibration detecting unit for detecting a residual vibration of the vibrating plate connected to each of the piezoelectric actuators;

a first switch unit having a first current capacitance which can connect an electrode on a ground side of the piezoelectric actuator and the ground;

a second switch unit having a second current capacitance which can connect the electrode on the ground side of the piezoelectric actuator and the ground; and a switch control unit for carrying out a predetermined opening and closing control of each of the first switch unit and the second switch unit when detecting a discharge abnormality of the nozzle, wherein said first current capacitance is greater than said second current capacitance.

2. The droplet discharging device according to claim 1, wherein the switch control unit serves to carry out a control to close the second switch unit in a state in which the first switch unit is maintained to be opened and to open the second switch unit after the driving signal is applied from the driving unit to the piezoelectric actuator corresponding to the nozzle selected by the nozzle selecting unit when detecting the discharge abnormality of the nozzle.

3. A droplet discharging device comprising:

a head unit including:

a plurality of droplet discharging heads having a vibrating plate;

a piezoelectric actuator for displacing the vibrating plate;

a cavity filled with a liquid and having a pressure in an inner part which is increased and decreased by the displacement of the vibrating plate; and a nozzle communicating with the cavity and serving to discharge the liquid as droplets by the increase and decrease in the pressure in the inner part;

a driving unit for outputting a driving signal to drive each of the piezoelectric actuators of the droplet discharging heads;

a nozzle selecting unit for selecting each of the nozzles of the droplet discharging heads and supplying the driving signal from the driving unit to the piezoelectric actuator corresponding to the nozzle thus selected;

a residual vibration detecting unit for detecting a residual vibration of the vibrating plate connected to each of the piezoelectric actuators;

a first switch unit having a first current capacitance which can connect an electrode on a around side of the piezoelectric actuator and the ground; and a second switch unit having a second current capacitance which can connect the electrode on the ground side of the piezoelectric actuator and the ground, wherein said first current capacitance is greater than said second current capacitance, and wherein the residual vibration detecting unit serves to detect an AC voltage generated between the ground and the electrode on the ground side of the piezoelectric actuator when the second switch unit is brought into an opening state and the electrode on the ground side of the piezoelectric actuator related to the nozzle to be a detection object is separated from the ground side in the detection of the discharge abnormality of the nozzle.

4. A droplet discharging device comprising:

a head unit including:

a plurality of droplet discharging heads having a vibrating plate;

a piezoelectric actuator for displacing the vibrating plate;

a cavity filled with a liquid and having a pressure in an inner part which is increased and decreased by the displacement of the vibrating plate; and a nozzle communicating with the cavity and serving to discharge the liquid as droplets by the increase and decrease in the pressure in the inner part;

a driving unit for outputting a driving signal to drive each of the piezoelectric actuators of the droplet discharging heads;

a nozzle selecting unit for selecting each of the nozzles of the droplet discharging heads and supplying the driving signal from the driving unit to the piezoelectric actuator corresponding to the nozzle thus selected;

a residual vibration detecting unit for detecting a residual vibration of the vibrating plate connected to each of the piezoelectric actuators;

a first switch unit having a first current capacitance which can connect an electrode on a ground side of the piezoelectric actuator and the ground; and a second switch unit having a second current capacitance which can connect the electrode on the around side of the piezoelectric actuator and the ground, wherein said first current capacitance is greater than said second current capacitance, and wherein the nozzle selecting unit serves to select the nozzles of the droplet discharging heads one by one based on data for nozzle selection and to supply the driving signal from the driving unit to the piezoelectric actuator corresponding to the nozzle thus selected when detecting the discharge abnormality of the nozzle.

5. A method of detecting a discharge abnormality of a droplet discharging device including a head unit including a plurality of droplet discharging heads having a vibrating plate, a piezoelectric actuator for displacing the vibrating plate, a cavity filled with a liquid and having a pressure in an inner part which is increased and decreased by the displacement of the vibrating plate, and a nozzle communicating with the cavity and serving to discharge the liquid as droplets by the increase and decrease in the pressure within the cavity, the method comprising the steps of:

selecting any of the piezoelectric actuators which is related to the nozzle to be a check object;

connecting one end of the piezoelectric actuator thus selected to a driving signal source and connecting the other end to a ground, thereby applying a driving signal to the piezoelectric actuator and driving the piezoelectric actuator, and discharging droplets from the nozzle; and separating an electrode on the ground side of the piezoelectric actuator from the ground side and detecting, as a residual vibration of the vibrating plate, an AC voltage generated between the ground and the electrode on the ground side of the piezoelectric actuator after discharging the droplets.

6. The method of detecting a discharge abnormality of a droplet discharging device according to claim 5, further comprising the step of deciding presence of a discharge abnormality of the nozzle to be a detection object based on the residual vibration detected at the detecting step.

7. The method of detecting a discharge abnormality of a droplet discharging device according to claim 5, wherein each of the selecting, discharging and detecting steps or each of the selecting, discharging, detecting and deciding steps is carried out for each of the piezoelectric actuators corresponding to each of the nozzles provided in each of the droplet discharging heads.

* * * * *